US006006396A

United States Patent [19]

Hellinger et al.

[11] Patent Number: 6,006,396

[45] Date of Patent: Dec. 28, 1999

[54] ICE SCRAPER

[75] Inventors: Gary L. Hellinger; Marilyn S. Hellinger, both of Greenwich, Conn.; Edward A. Wagschal, New York, N.Y.

[73] Assignee: Gary Plastic Packaging Corp., Bronx, N.Y.

[21] Appl. No.: 09/156,910

[22] Filed: Sep. 18, 1998

[51] Int. Cl.[6] ..... A47L 13/02; B25G 1/04

[52] U.S. Cl. ..... 15/236.02; 15/236.01; 15/144.4; 15/143.1

[58] Field of Search ..... 15/143.1, 144.4, 15/236.01, 236.02

[56] References Cited

U.S. PATENT DOCUMENTS

| | | | |
|---|---|---|---|
| 2,162,117 | 6/1939 | Perry | 15/143.1 |
| 3,036,322 | 5/1962 | Jorgensen . | |
| 3,683,496 | 8/1972 | Johnson . | |
| 4,040,140 | 8/1977 | Hopkins et al. . | |
| 4,141,111 | 2/1979 | Hopkins et al. . | |
| 4,164,801 | 8/1979 | Thomas . | |
| 4,275,476 | 6/1981 | Hopkins | 15/236.02 |
| 4,538,320 | 9/1985 | Batt . | |
| 4,567,616 | 2/1986 | Lyons . | |
| 4,612,707 | 9/1986 | Shea . | |

*Primary Examiner*—Randall E. Chin
*Attorney, Agent, or Firm*—Fish & Neave; Jeffrey H. Ingerman

[57] ABSTRACT

An ice scraper includes a body, as well as a sleeve that can be mounted on the body in either of two orientations. The sleeve can be mounted in either orientation at will, but is locked once mounted. The sleeve has opposing holes in its upper and lower surfaces which together serve as a hanger hole for retail display. A locking tab on the body engages the edge of one of those holes, depending on the selected orientation, to lock the sleeve in place, but does not interfere with mounting of the sleeve.

8 Claims, 5 Drawing Sheets

ICE SCRAPER

BACKGROUND OF THE INVENTION

This invention relates to ice scrapers. More particularly, this invention relates to ice scrapers including a body and a handle sleeve, wherein the handle sleeve can be mounted in either of two orientations, but is locked in position once mounted.

Ice scrapers for removing ice and snow from automobile windshields are well known. Generally, the functional portion of an ice scraper is an edge designed for scraping against the windshield to dislodge ice or snow. The remainder of the ice scraper bears the edge and provides a handhold for a user to scrape the working edge against the windshield surface. The working edge is generally made of plastic.

While the working edge must be substantially straight to contact the glass surface, the shape of the remainder of the ice scraper is determined by the need for the user to be able to hold the ice scraper in a comfortable and useful position, and by aesthetic considerations. Because the working edge is generally a plastic, the ice scraper as a whole can be molded from plastic in almost any shape.

One popular shape for an ice scraper is substantially triangular. The body of the ice scraper is relatively wide at the working edge to remove as much ice or snow as possible in a single stroke, but tapers substantially to a point remote from the working edge to form a comfortable handhold that provides good leverage for the user. The ice scraper may be substantially planar, or may curve in a plane perpendicular to the line defined by the working edge.

Such ice scrapers can be molded as a single piece of plastic. More commonly however, the working edge is made from a hard material such as polystyrene or a methacrylate plastic. Such ice scrapers are frequently covered by a sleeve of a preferably resilient material that is more comfortable to hold. The sleeve may be provided with surface treatment on one or both sides to further enhance the user's grip. For example, grooves or a roughened surface may be provided.

Ice scrapers are frequently given away as promotional items by businesses. The businesses may want to imprint the ice scraper with advertising material as part of such a promotion. Imprinting preferably would be done where there is no surface treatment. Different businesses may want different-sized imprints. At the same time, different surface treatments may provide different-sized areas for imprinting. For example, it may be best for the user's grip to provide one surface that has a surface treatment and one that does not; in such a case a larger imprint could be provided on the untreated surface.

It is desirable from a promotional point of view to have the imprint on the upper surface of the ice scraper. Thus, depending on whether the advertiser wants a large or a small imprint, a supplier of blank ice scrapers for imprinting might want to be able to provide the ice scraper with the surface treatment on either the top or the bottom. If the sleeve is fastened to the body, the manufacturer would have to stock two different types of ice scrapers, even though the same sleeve could be mounted in either orientation. However, if the sleeve is not fastened to the body, it could separate from the body during use.

It would therefore be desirable to be able to provide an ice scraper in which the sleeve could be mounted on the body and locked once mounted, but in which the orientation of the sleeve is not predetermined so that it can be mounted in one of two orientations and not be locked in place until mounted.

SUMMARY OF THE INVENTION

It is an object of this invention to provide an ice scraper in which the sleeve can be mounted on the body and locked once mounted, but in which the orientation of the sleeve is not predetermined so that it can be mounted in one of two orientations and not be locked in place until mounted.

In accordance with the present invention, there is provided an ice scraper comprising a body and a resilient handle sleeve. The body has a working edge at a first end thereof, and has a handhold extension extending from a second end thereof opposite the first end. The handhold extension has a body upper surface, a body lower surface, and a handhold extension length, and terminates at an extension end. The handle sleeve has a first major sleeve surface, a second major sleeve surface opposite the first major sleeve surface, an open end for receiving the handhold extension and a closed end opposite the open end. The handle sleeve has a sleeve length between the open end and the closed end and is dimensioned to fit over the handhold extension in one of (a) a first position in which the first sleeve surface is adjacent the body upper surface and the second sleeve surface is adjacent the body lower surface, and (b) a second position in which the first sleeve surface is adjacent the body lower surface and the second sleeve surface is adjacent the body upper surface. The first sleeve surface has a first hole therein adjacent the closed end. The second sleeve surface has a second hole therein adjacent the closed end and substantially directly opposite the first hole. Each of said first and second holes has a respective edge remote from the closed end, and the respective edges are substantially opposite one another. The ice scraper further comprises a locking tab extending from the extension end beyond either the body upper surface or the body lower surface. When the handle sleeve is being mounted on the handhold extension in the first or second position, the handle sleeve deforms to pass over the locking tab. After the handle sleeve has been mounted on the handhold extension in the first or second position, the locking tab engages one of the respective edges of the first or second hole to prevent removal of the handle sleeve from the handhold extension.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
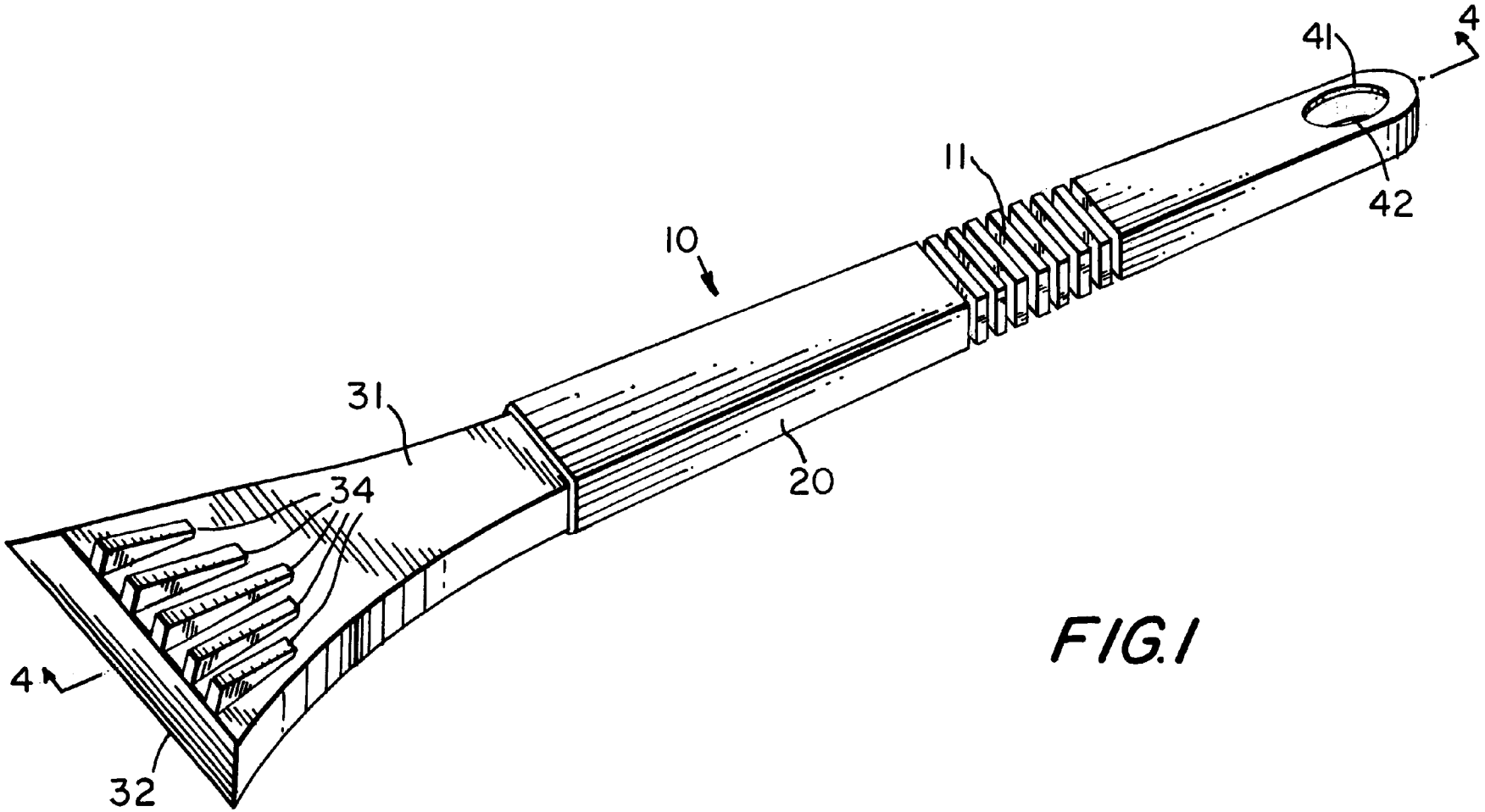
FIG. 1 is a perspective view of a preferred embodiment of an ice scraper according to the present invention in a first configuration.
Figure 2:
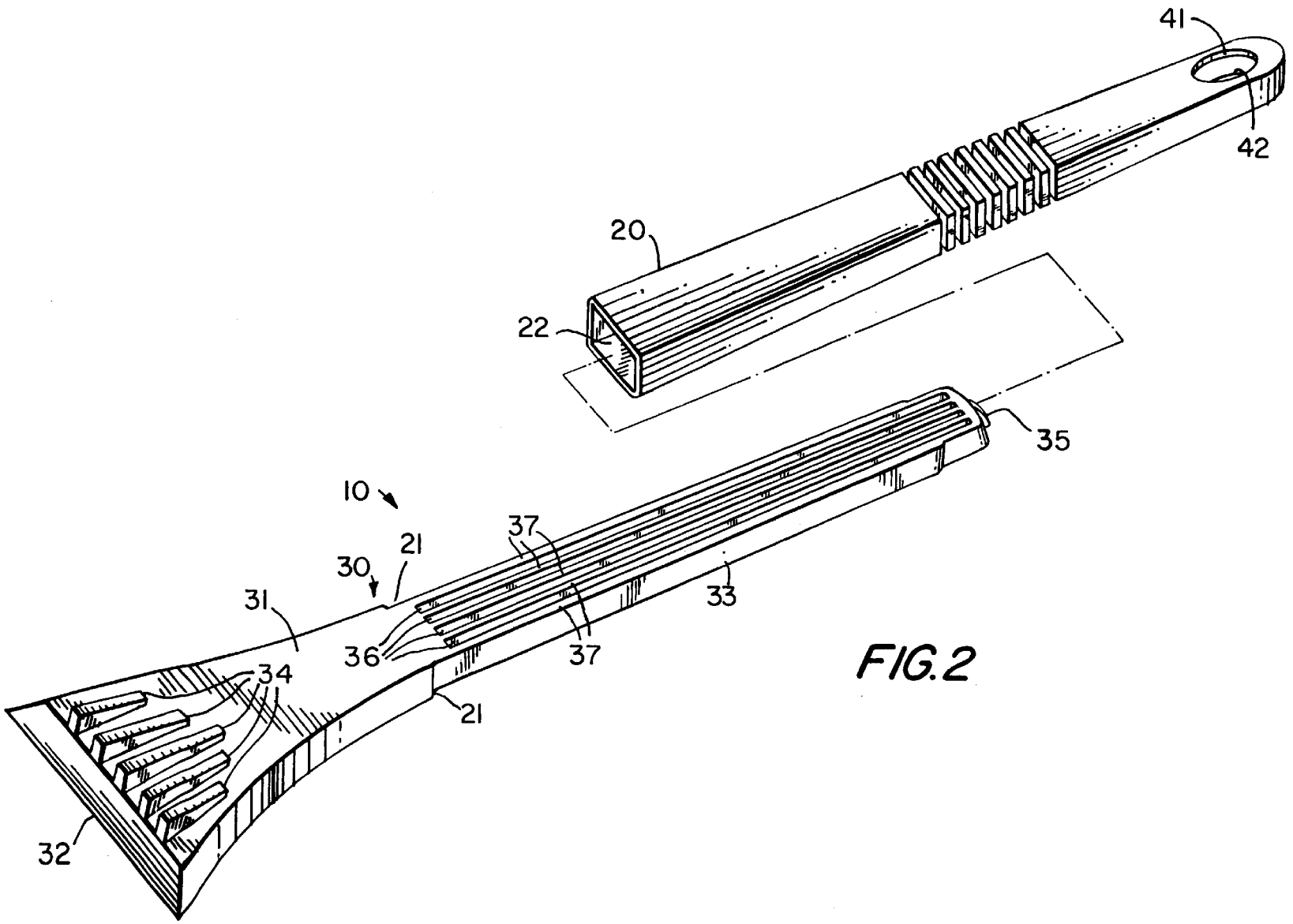
FIG. 2 is an exploded perspective view of the ice scraper of FIG. 1.
Figure 3:
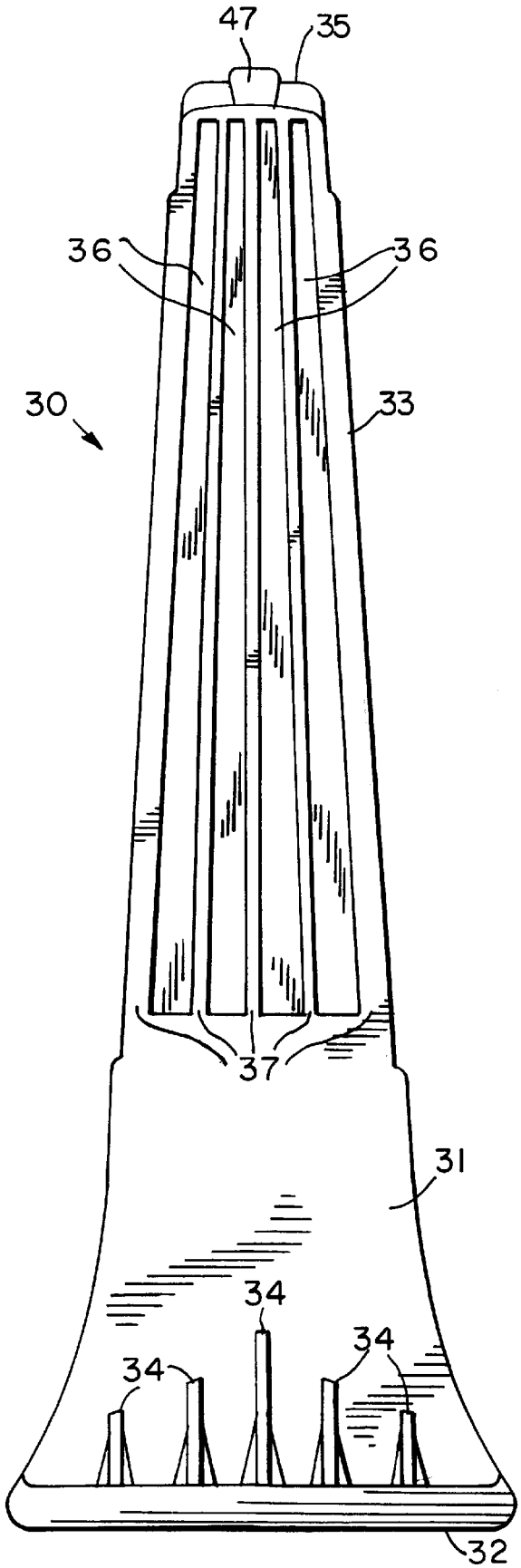
FIG. 3 is a plan view of the body portion of the ice scraper of FIGS. 1 and 2.

The present invention relies on the presence in most ice scrapers of hanger holes, provided to allow an ice scraper to be hung for retail display on a hook or peg. The hole must extend through both sides of the ice scraper, and therefore if the ice scraper has a handle sleeve, there is a hole in both sides of the handle sleeve of the ice scraper.

In accordance with the invention, instead of extending the handhold extension of the ice scraper body to the end of the handle sleeve and providing a hole in the handhold extension aligned with the holes in the upper and lower surfaces of the sleeve, the handhold extension preferably is terminated short of the holes in the first and second surfaces of the handle sleeve. The retail display function is unaffected, as the hook or peg of a retail display can pass just as easily through empty space within the handle sleeve as it could through a hole in the handhold extension of the body.

To lock the handle sleeve to the ice scraper body, a locking tab is provided preferably on the end of the handhold extension, extending beyond one of the body upper and lower surfaces, adjacent the holes in the first and second sleeve surfaces. The locking tab preferably extends substantially perpendicularly to the first and second sleeve surfaces in the direction of one of those surfaces, extending beyond the body upper surface or the body lower surface by a distance preferably at most equal to the thickness of the material of the sleeve, and more preferably by less than that thickness. In that way, when the sleeve is mounted on the handhold extension of the body, the tab does not extend beyond the outer surface of the sleeve. However, the tab should extend by a sufficient fraction of the sleeve material thickness to prevent removal of the sleeve from the handhold extension.

The tab engages the forward edge of the hole in one of the sleeve surfaces—i.e., the edge of the hole remote from the closed end of the sleeve and closer to the working edge of the ice scraper—so as to prevent removal of the sleeve from the body. However, the sleeve can easily be mounted because the sleeve is preferably flexible and there is significant maneuvering room at the open "mouth" of the sleeve, which is as wide as the widest part of the handhold extension, for insertion of the narrow end of the handhold extension while flexing or deforming the sleeve walls. To further facilitate mounting of the sleeve on the handhold extension, the side of the locking tab facing away from the working edge is preferably chamfered to allow the wall of the sleeve to more easily pass over the tab. After the sleeve has been mounted, it preferably resumes its undeformed shape.

Although in the first preferred embodiment the handhold extension preferably ends substantially adjacent the holes in the first and second sleeve surfaces, the handhold extension could be made longer, up to the length of the interior of the sleeve. The locking tab still would extend from the handhold extension at position in which it will engage the forward edge of the hole in either of the first and second sleeve surfaces. If in a second preferred embodiment the handhold extension is made as long as the interior of the sleeve, it could be provided with a hole that aligns with the holes in the sleeve surfaces, so that the hanging display function is unimpaired. In such an embodiment, the locking tab preferably would extend from the forward edge of the hole in the handhold extension—i.e., that edge that is closest to the working edge of the ice scraper.

The handhold extension could also be of some intermediate length—longer than in the first preferred embodiment but shorter than in the second preferred embodiment. If in such an embodiment the handhold extension extends beyond the holes in the first and second sleeve surfaces, then it would be functionally substantially identical to the second preferred embodiment. However, in a third preferred embodiment, the handhold extension could extend beyond the forward edges of the holes in the sleeve surfaces, but not beyond those holes. In such an embodiment, the handhold extension could be provided with a cutout or "partial hole" aligned with that portion of the holes in the sleeve surfaces that otherwise would be blocked. The locking tab in such an embodiment preferably would extend from the forward edge of the partial hole.

It will be understood from the foregoing description that the handle sleeve could be mounted on the handhold extension in either of two desired orientations. The edge of the hole in one of the major sleeve surfaces will engage the locking tab to prevent removal of the sleeve from the body. Although the sleeve may be able to be removed by use of a suitable tool to deform the sleeve, or by otherwise deforming the sleeve, it is not intended that the sleeve be removed. More importantly, it is unlikely that the sleeve will come loose accidentally while the ice scraper is in use.

The invention will now be described with reference to FIGS. 1–5.

Ice scraper 10 has a body 30 including a main body portion 31, a working edge 32 at one end of main body portion 31, and a handhold extension 33 extending from a second end of main body portion 31 opposite the first end. Body 30 may be made from any suitable material provided that working edge 32 is sufficiently hard to serve its function of dislodging ice from a windshield. Preferably, body 30 is made from polystyrene, although it could be made from any hard plastic such as a methacrylate plastic. Main body portion 31 preferably has ribs 34 adjacent working edge 32 to provide extra rigidity to prevent breakage of working edge 32 in use, and also for use as ice breakers in case thick or stubborn ice is encountered.

A handle sleeve 20 preferably is telescopically received on handhold extension 33. Handle sleeve 20 is preferably made from a resilient material such as polyethylene. Handle sleeve 20 preferably is longer than handhold extension 33 so that there is empty space 40 between extension end 35 of handhold extension 33 and closed end of handle sleeve 20. openings 41, 42 in first and second main surfaces 43, 44, respectively, of handle sleeve 20 preferably communicate with empty space 40.

Handhold extension 33 preferably has areas 36 where material is removed, leaving ribs 37 therebetween. Ribs 37 strengthen handhold extension 33 against breakage caused by force exerted during use that tends to bend handhold extension 33 out of its plane—i.e., about a line substantially parallel to working edge 32. In addition, the removal of material from areas 36 reduces the contact area between body upper surface 45 and the inside of main surface 43 or 44 (depending on the assembly configuration as discussed below) to the area of ribs 37. Although body lower surface 46 is fully in contact with main surface 44 or 43, the reduction of the contact area between body upper surface 45 and main surface 43 or 44 nevertheless reduces friction between body 30 and sleeve 20, easing assembly.

Preferably, handhold extension 33 is not as wide as main body portion 31, resulting in the presence of shoulders 21 that limit the insertion of handhold extension 33 into sleeve 20. This prevents breakage of sleeve 20 by preventing someone from forcing handhold extension 33 too far into empty space 40, and also insures that holes 41, 42 are properly aligned with locking tab 47.

Locking tab 47 preferably depends from extension end 35 of handhold extension 33. Although locking tab 47 as shown extends downward from body lower surface 46, it could also extend upward from body upper surface 45. Locking tab 47 preferably engages that edge of hole 41 or 42 (depending on the assembly orientation chosen for sleeve 20) that is closer to working edge 32, preventing sleeve 20 from being removed from handhold extension 33 once it has been mounted. As can be seen, locking tab 47 is preferably chamfered in the direction away from working edge 32, so that main surface 43 or 44 (again depending on assembly orientation) can more easily ride up over locking tab 47 during mounting of sleeve 20 on handhold extension 33. The distance that locking tab 47 extends beyond body upper surface 45 or body lower surface 46 is preferably at most equal to the thickness of the walls 43, 44 of sleeve 20, so that locking tab 47 does not protrude from hole 41 or 42. More preferably, as shown, locking tab 47 extends less than the thickness of walls 43, 44, but not so little that it does not effectively prevent removal of sleeve 20 from handhold extension 33.

It will be appreciated that if shoulders 21 were not provided, the resilient nature of the preferred material of sleeve 20 would allow sleeve 20 to be forced farther onto handhold extension 33 than intended. In such a case, locking tab 47 might not line up with the forward edge (i.e., the edge closer to working edge 32) of hole 41 or 42, with the result that while locking tab 47 would still prevent removal of sleeve 20 from handhold extension 33, sleeve 20 might be free to move back and forth to a limited degree. Shoulders 21 preferably provide a stop that preferably prevents such back-and-forth motion.

Figure 4:
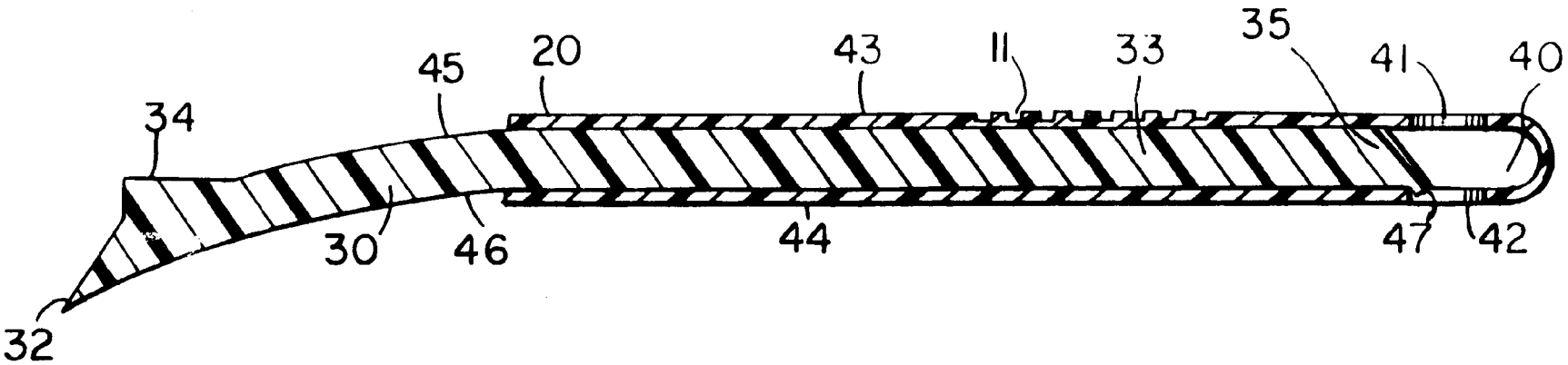
FIG. 4 is a cross-sectional view of the ice scraper of FIGS. 1 and 2, taken from line 4—4 of FIG. 1.
Figure 5:
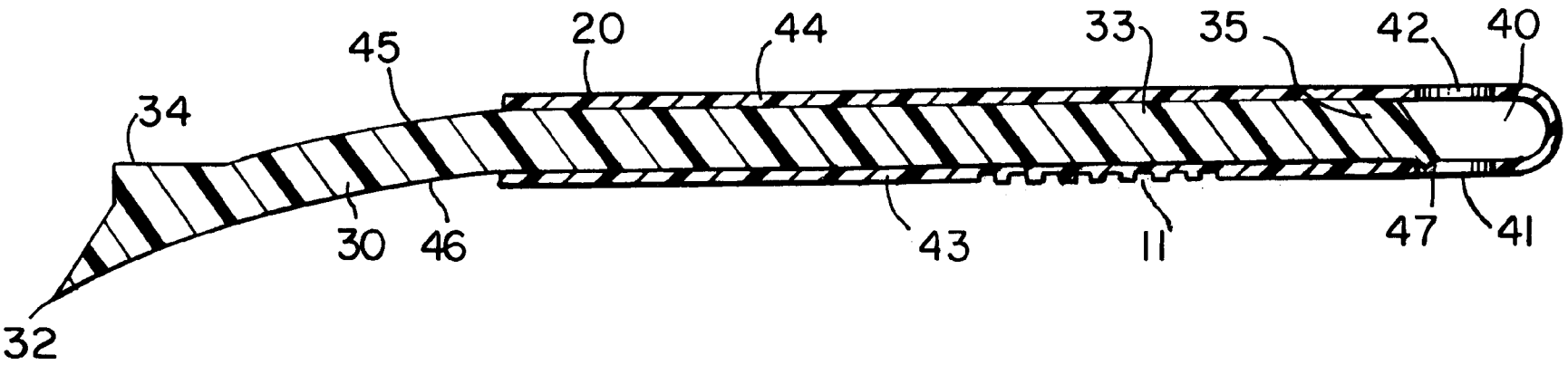
FIG. 5 is a cross-sectional view of the ice scraper of FIGS. 1 and 2, similar to FIG. 4, but in a second configuration.

Sleeve 20 preferably is provided with a surface treatment 11. As best seen in FIGS. 4 and 5, surface treatment 11 is present on main sleeve surface 43 but absent from main sleeve surface 44. For reasons such as those discussed above, a first customer might want main sleeve surface 43 with surface treatment 11 to be adjacent body upper surface 45 (FIG. 4), while a second customer might want main sleeve surface 43 with surface treatment 11 to be adjacent body lower surface 46 (FIG. 5). According to the invention, both customers can be satisfied by the manufacturer, who need manufacture only one type of body 30 and only one type of sleeve 20.

To satisfy the first customer, the manufacturer mounts sleeve 20 as shown in FIGS. 1–4, inserting handhold extension 33 into open end 22 of sleeve 20, deforming sleeve 20 to the extent necessary for main surface 44 to ride over locking tab 47, until sleeve 20 abuts shoulders 21, at which time locking tab 47 will have engaged the forward edge of hole 42. Sleeve 20 is now locked (although it might be removable by suitably deforming sleeve 20, e.g., with an appropriate tool).

To satisfy the second customer, the manufacturer mounts sleeve 20 as shown in FIG. 5, inserting handhold extension 33 into open end 22 of sleeve 20, deforming sleeve 22 to the extent necessary for main surface 43 to ride over locking tab 47, until sleeve 20 abuts shoulders 21, at which time locking tab 47 will have engaged the forward edge of hole 41. Sleeve 20 again will be locked in place.

Although as shown in FIGS. 1–5, only one of the two main sleeve surfaces 43, 44 has a surface treatment 11, surfaces 43, 44 could be provided with two different surface treatments, with the customer having a choice as to which surface treatment is adjacent body upper surface 45 and which surface treatment is adjacent body lower surface 46. Indeed, the embodiment shown can be considered to be a special case where one of the two surface treatments that are provided is a plain or smooth surface treatment.

Thus it is seen that an ice scraper in which the sleeve can be mounted on the body and locked once mounted, but in which the orientation of the sleeve is not predetermined so that it can be mounted in one of two orientations and not be locked in place until mounted, has been provided. One skilled in the art will appreciate that the present invention can be practiced by other than the described embodiments, which are presented for purposes of illustration and not of limitation, and the present invention is limited only by the claims which follow.

What is claimed is:

1. An ice scraper comprising:

a body having a working edge at a first end thereof, and having a handhold extension extending from a second end thereof opposite said first end, said handhold extension having a body upper surface, a body lower surface, and a handhold extension length, said handhold extension terminating at an extension end; and a resilient handle sleeve covering said handhold extension, said handle sleeve having a first major sleeve surface, a second major sleeve surface opposite said first major sleeve surface, an open end for receiving said handhold extension and a closed end opposite said open end, said handle sleeve having a sleeve length between said open end and said closed end and being dimensioned to fit over said handhold extension in one of (a) a first position in which said first sleeve surface is adjacent said body upper surface and said second sleeve surface is adjacent said body lower surface, and (b) a second position in which said first sleeve surface is adjacent said body lower surface and said second sleeve surface is adjacent said body upper surface; wherein:

said first sleeve surface has a first hole therein adjacent said closed end;

said second sleeve surface has a second hole therein adjacent said closed end and substantially directly opposite said first hole; and each of said first and second holes having a respective edge remote from said closed end, said respective edges being substantially opposite one another; said ice scraper further comprising:

a locking tab extending from said body beyond one of said body upper surface and said body lower surface; whereby:

when said handle sleeve is being mounted on said handhold extension in one of said first and second positions, said handle sleeve deforms to pass over said locking tab; and after said handle sleeve has been mounted on said handhold extension in said one of said first and second positions, said locking tab engages one of said respective edges of one of said first and second holes to prevent removal of said handle sleeve from said handhold extension.

2. The ice scraper of claim 1 wherein said locking tab is chamfered on a side remote from said first end to facilitate passage of said handle sleeve over said locking tab.

3. The ice scraper of claim 1 wherein each of said first and second surfaces has a respective thickness, said thicknesses of said first and second surfaces being substantially identical, said locking tab extending beyond said one of said first and second body surfaces by at most said thickness.

4. The ice scraper of claim 3 wherein said locking tab extends beyond said one of said first and second body surfaces by less than said thickness.

5. The ice scraper of claim 1 wherein said first surface has a first surface treatment, and said second surface has a second surface treatment different from said first surface treatment; whereby:

said sleeve can be mounted in one of (a) a position in which said first surface treatment is adjacent said upper surface and said second surface treatment is adjacent said lower surface, and (b) a position in which said first surface treatment is adjacent said lower surface and said second surface treatment is adjacent said upper surface.

6. The ice scraper of claim 5 wherein at least one of said first and second surface treatments is a grip-enhancing treatment.

7. The ice scraper of claim 1 wherein said handhold extension has a plurality of ribs extending along at least one of said upper and lower surfaces defining depressions therebetween, whereby contact area between said at least one surface and at least one of said first and second surfaces is reduced, minimizing friction as said handle sleeve is mounted on said handhold extension.

8. The ice scraper of claim 1 wherein:

said sleeve length exceeds said handhold extension length, such that when said handle sleeve is mounted on said handhold extension in one of said first and second positions, said closed end is spaced from said extension end; and said locking tab extends from said extension end.

* * * * *

UNITED STATES PATENT AND TRADEMARK OFFICE
CERTIFICATE OF CORRECTION

PATENT NO : 6,006,396

DATED : December 28, 1999

INVENTOR(S) : Gary L. Hellinger et al.

It is certified that error appears in the above-identified patent and that said Letters Patent are hereby corrected as shown below:

Column 4, line 39, after "end" should be inserted -- 22 --.

line 40, "openings" should be -- Openings --.

Signed and Sealed this

First Day of May, 2001

*Attest:*

Nicholas P. Godici

NICHOLAS P. GODICI

*Attesting Officer*

*Acting Director of the United States Patent and Trademark Office*